United States Patent [19]

Payne et al.

[11] 4,135,085

[45] Jan. 16, 1979

[54] CHARGING DEVICE FOR BASECOAT CHARGING OF CAN ENDS

[75] Inventors: Robert D. Payne, Countryside; Boris J. Kirsanoff, Darien, both of Ill.

[73] Assignee: The Continental Group, Inc., New York, N.Y.

[21] Appl. No.: 823,452

[22] Filed: Aug. 10, 1977

[51] Int. Cl.[2] ..... H01T 19/04

[52] U.S. Cl. ..... 250/325; 250/324

[58] Field of Search ..... 250/325, 326, 327, 492; 313/447, 243; 361/225

[56] References Cited

U.S. PATENT DOCUMENTS

| | | | |
|---|---|---|---|
| 2,778,946 | 1/1957 | Mayo | 250/325 |
| 3,638,016 | 1/1972 | Frank | 250/326 |
| 3,678,350 | 7/1972 | Matsumoto et al. | 250/325 |
| 3,744,898 | 7/1973 | Kurahashi et al. | 250/325 |
| 3,778,622 | 12/1973 | Kobayashi et al. | 250/324 |
| 3,797,927 | 3/1974 | Takahashi et al. | 250/325 |

*Primary Examiner*—Bruce C. Anderson
*Attorney, Agent, or Firm*—Charles E. Brown

[57] ABSTRACT

An apparatus for providing a uniform charge upon a surface of a conductive base, the apparatus includes a longitudinally elongated corona discharge element, a potential source connected to the discharge element for applying a corona-generating potential, conveyor means for conveying at least one conductive base along a path in a direction along the length of the discharge element and a protective grid assembly disposed directly adjacent the discharge element. The grid assembly includes protective elements having sufficient resistance to prevent the conveyed base from contacting the discharge element and to cast a persistent electrical shadow on the conveyed base. The protective elements are skewed longitudinally of the discharge element and relative to the direction of the conveyed base whereby the electrical shadow cast by the protective element is equally distributed over the conveyed base.

8 Claims, 4 Drawing Figures

CHARGING DEVICE FOR BASECOAT CHARGING OF CAN ENDS

This invention relates to the art of manufacturing container units and is more particularly concerned with uniformly charging the surface of a conductive container unit while protecting the charging apparatus against damage by a loose container unit.

End units for food or beverage cans are typically formed from a flat metal sheet which has a roller applied organic protective coating. The organic coating becomes part of the can exterior surface, prevents the migration of metal ions into the contained product, and prevents corrosion of the end unit metal by the product. The organic coating material, which is in use to day, has been formulated to survive the stretching, scoring, scratching of an end unit through a deforming process thereof with a minimum of metal exposure. The minimum amount of metal exposed during the forming of the end unit is normally acceptable for many container applications. However, there are several specific types of end units in which minimum metal exposure generated by scoring or cutting of the organic coating is unacceptable. A specific example of an end unit where metal exposure must be minimized by use of a repair coating is an easy opening end unit having pouring and vent holes formed therethrough. Raw metal is exposed when the pouring and vent holes are punched through the material of this end unit. This raw material and any other metal exposure is normally repaired by coating the end unit with electrostatically charged powder.

Proper application of the electrostatically charged powder for the purpose of repairing the base coat requires charging the raw and exposed metal of the end unit prior to the application thereof. The charging of the end unit is performed by way of high potential corona emission requiring a normally exposed corona discharge element. One of the disadvantages of using an exposed corona discharge element is that a loose end unit, for example, may accidentally contact the discharge element with resultant damaging of the discharge element. Therefore, it has been found necessary to utilize a protective grid which is disposed directly adjacent the exposed corona discharge element. The protective grid mechanically prevents a loose end unit from getting close enough to the exposed corona discharge element to cause damage thereto.

The disadvantage associated with the utilization of the protective grid is that the grid itself must be of sufficient resistance in order to deflect an end unit conveyed along a given path. This sufficient resistance creates an electrical shadow upon the end unit, as the end unit passes the corona discharge element, resulting in distinct linear regions of non-uniform charging upon the basecoat of the end unit. If these linear regions occur at the cut-edge of a hole, as a result of the random orientation of the end units, unacceptable metal exposure occurs on the resultant coated end unit. The electrical shadow which is cast by the protective grid generates a non-uniform coating. This non-uniform coating results in feathering and windowing appearance which is unacceptable when the end unit is opened and further results in possible metal exposure and contamination of the container contents.

It is therefore the object of this invention to provide an apparatus which utilizes a protective grid having sufficient resistance to prevent damage to the corona discharge element and while the protective grid generates an electrical shadow, the protective grid is arranged in a manner such that the electrical shadow is distributed uniformly upon the surface of the conductive base to provide for uniform charging of the conductive base.

With the above, and other objects in view that will hereinafter appear, the nature of the invention will be more clearly understood by reference to the following detailed description, the appended claims and the several views illustrated in the accompanying drawings.

IN THE DRAWINGS

FIG. 1 is a schematic plan view of an end unit being conveyed past a longitudinally elongated corona discharge element provided with a protective grid in accordance with this invention.

FIG. 2 is a side elevational view illustrating the position of the protective grid in FIG. 1 relative to the associated corona discharge.

FIG. 3 is a schematic plan view of another embodiment of conveyor means and corona discharge element with protective grid disposed in between.

FIG. 4 is a side elevational view illustrating the structural configuration of the protective grid of FIG. 2 and the position thereof relative to the associated corona discharge element.

Figures 1, 2, 3, 4:
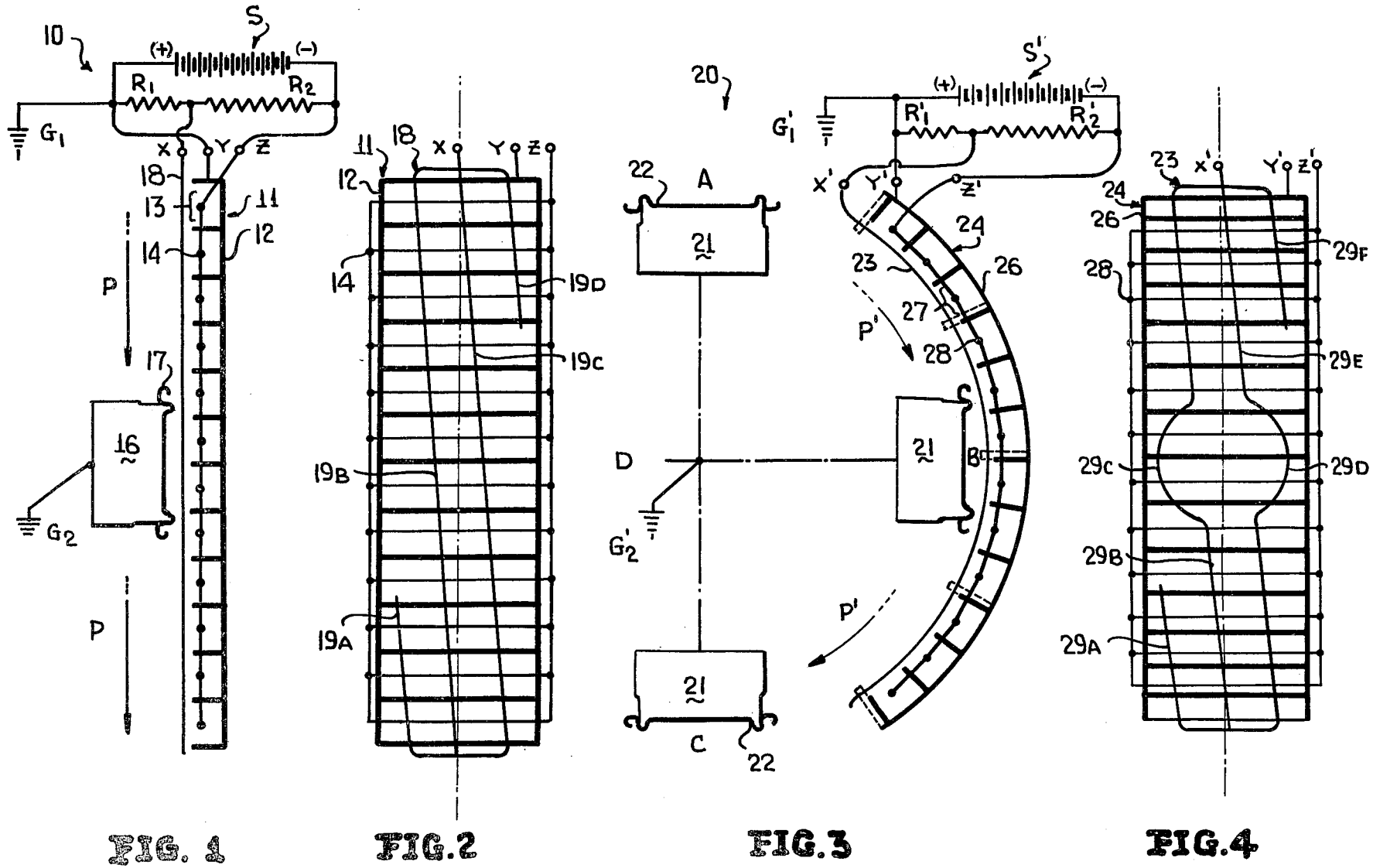

Referring now to the drawings in detail, it will be seen that in FIG. 1 there is shown an apparatus for providing a uniform charge to a surface (not specifically illustrated) of a conductive base, the apparatus being generally designated by reference numeral 10. The apparatus 10 includes longitudinally elongated corona discharge element 11 which is formed of a plurality of longitudinally adjacent U-shaped channels 12 having open mouth portions 13 and a charging wire 14 recessed within each of the U-shaped channels 12. Electrical energy is supplied to the corona discharge element 11 by a potential source S which has an electrically grounded positive terminal (+) and a negative terminal (−) providing high voltage direct current. The positive terminal (+) of the potential source S is grounded at point G1 and connected to the adjacent U-shaped channels 12 at point Y. The U-shaped channels 12 are arranged in such a manner that a continuous corona emission is provided from the charging wires 14. The negative terminal (−) of the potential source S is electrically connected to a common wire for the charging wires 14 at point Z for generating a negative ionic charge in the form of a corona emission from the charging wire 14.

Conveyor means in the form of a carrier 16 is operable to move a conductive base (end unit) 17 along a path in a direction P longitudinally along the length of the corona discharge element 11 with the end unit 17 being disposed closely adjacent to the corona discharge element 11. The end unit 17 is electrically grounded to the carrier 16, which is in turn grounded at point G2 and is physically held at a fixed distance from the corona discharge element 11.

In the application of an electrostatic charge upon the end unit 17, the potential source S supplies a voltage charge of 8,000 volts to the charging wires 14 which are relatively fragile, typcially having a diameter of six thousandths of an inch. It has been found that during the electrostatic charging of the end units 17, infrequently end units 17 have become loose and fallen from the carrier 16. The loose end units 17 may accidentally contact the corona discharge element 11 which results in damaging of the charging wires 15. Therefore, a protective grid 18 is disposed directly adjacent the corona discharge element 11 facing the open portions 13 of the U-shaped channels 12. The protective grid 18 is constructed of a sufficient resistance to mechanically prevent a loose end unit 17 from contacting the charging wires 14.

The potential source S further includes a voltage reduction means in the form of a voltage divider including resistors R1 and R2 for reducing the voltage of the potential source S in order that a bias voltage of a voltage less than that applied to the charging wires 14, can be applied to the protective grid 18 at point X. The bias voltage applied to the protective grid 18, which may be on the order of 3,000 volts, maximizes the corona emission available for charging the end unit 17.

Referring now to FIG. 2, it will be seen that the protective grid 18 includes interconnected protective elements 19*a*, 19*b*, 19*c* and 19*d* which are skewed longitudinally of the corona discharge element 11 and transversely relative to the direction of movement of the conveyed end unit 17, whereby an electrical shadow cast by the interconnected protective elements 19*a*, 19*b*, 19*c* and 19*d* is equally distributed over the conveyed end unit 17. The positioning and resistance of the protective elements 19*a*, 19*b*, 19*c* and 19*d* prevent the conveyed end unit 17 from contacting the charging wires 14.

In FIG. 3 there is another embodiment of the present invention which is generally referred to by the numeral 20. Conveyor means of the apparatus 20 is in the form of a carrier of the turret type (not specifically illustrated) which includes a plurality of vacuum chucks 21. The chucks 21 are symetrically arranged on an intermittently rotating turret (not specifically illustrated), and are rotated along an arcuate path in a direction P'.

Each chuck 21 is rotated past a series of stations, respectively referred to by alphabetical letters A, B, C, D. Initially, at station A (not specifically illustrated), a conductive base (end unit) 22 is retained by one of the chucks 21. Each end unit 22 is electrically grounded to the chuck 21 which is in turn grounded through the turret (not specifically illustrated) to point G2'.

Each end unit 22 is then conveyed and dwelled in timed relationship along the arcuate path in the direction P' to the remaining stations B, C and D. At station B, each end unit 22 is electrostatically charged. Having been charged, each end unit 22 is moved to station C (not specifically illustrated) where a coating material is applied. Finally, after being coated, each end unit 22 is moved to station D (not illustrated) where each coated end unit 22 is removed.

We are particularly concerned with station B, where a protective grid 23 and a corona discharge element 24 are disposed at a fixed distance transversely adjacent the retained end unit 22. The protective grid 23 and the corona discharge element 24 have been arcuately curved to concentrically match the arcuate path of the chuck 21 along the direction P' at station B. The corona discharge element 24 is arcuately longitudinally elongated and formed of a plurality of longitudinally adjacent U-shaped channels 26 having open mouthed portions 27 and a charging wire 28 recessed within each of the U-shaped channels 26. The corona discharge element 24 is connected to a potential source S' which has a positive terminal (+) and a negative terminal (−). The negative terminal (−) of the potential source S' is connected to a common wire for the charging wires 18 at point Z'. A voltage of 8,000 volts is applied to the charging wires 28, thereby generating a corona emission for electrostatically charging each end unit 22. The positive terminal (+) of the potential source S' is grounded at point G1' and connected at point Y' to the longitudinally adjacent U-shaped channels 26.

The protective grid 23, in accordance with the novelty of this invention, is disposed directly adjacent the open mounted portions 27 fo the U-shaped channels 26 and relative to the arcuate path in the direction P' of the rotating chuck 21. The protective grid 23 mechanically preventing a loose end unit 22 from contacting the charging wires 28 which are relatively fragile. The protective grid 23 is constructed of sufficient resistance to deflect a loose end unit 22. A bias voltage may be applied to the protective grid 23, which may be on the order of 3,000 volts and thereby maximizes the corona emission available for charging each end unit 22.

Referring now to FIG. 4 it will be seen that the protective grid 23 includes interconnected protective elements 29*a*, 29*b*, 29*c*, 29*d*, 29*e* and 29*f* which are skewed longitudinally of the corona discharge element 24 and transversely relative to the direction of movement of each conveyed end unit 22 whereby an electrical shadow cast by the protective elements 29*a*, 29*b*, 29*c*, 29*d*, 29*e* and 29*f* is equally distributed over each conveyed end unit 22 passing station B. The protective elements 29*c* and 29*d* have been rearranged so that during the momentary dwell when each end unit 22 is stationed directly adjacent the corona discharge element 24, the area of each conveyed end unit 22 to be charged receives an uninterrupted corona emission charge and no distinct linear region of non-uniform charging occurs on the end unit 22.

Although only preferred embodiments of the invention have been specifically illustrated and described herein, it is to be understood that minor variations may be made without departing from the spirit and scope of the invention, as defined in the appended claims.

We claim:

1. An apparatus for providing a uniform charge upon a surface of a conductive base, said apparatus comprising a longitudinally elongated corona discharge element, a potential source connected to said discharge element for applying a corona-generating potential to said discharge element, conveyor means for conveying at least one conductive base along a path in a direction along the length of said discharge element wherein the base is charged, a protective grid assembly disposed directly adjacent said discharge element, said grid assembly including protective elements having sufficient resistance to prevent the conveyed base from contacting said discharge element and of a size to cast a persistent electrical shadow upon the conveyed base, said protective elements extending primarily longitudinally of said discharge element and relative to the direction of the conveyed base while being skewed transversely whereby the electrical shadow cast by said protection elements is equally distributed over the conveyed base.

2. The apparatus of claim 1 wherein said discharge element is arcuately longitudinally elongated and the path of said conveyor means is arcuate along said discharge element.

3. The apparatus of claim 1 wherein said conveying means dwells at a point along the length of said discharge element to temporarily render the conveyed base stationary, and said protective elements at said point are arranged to outline an area of said discharge element corresponding to and aligned with the stationary base whereby an electrical shadow on the base is absent during said dwell.

4. The apparatus of claim 2 wherein said conveying means dwells at a point along the length of said discharge element to temporarily render the conveyed base stationary, and said protective elements at said point are arranged to outline an area of said discharge element corresponding to and aligned with the stationary base whereby an electrical shadow on the base is absent during said dwell.

5. The apparatus of claim 1 wherein said discharge element includes a plurality of longitudinally adjacent U-shaped channels having open portions thereof disposed transversely of said grid assembly, and a charging wire is recessed within each of said channels.

6. The apparatus of claim 1 wherein said apparatus includes a second potential source, said second potential source being connected to said protective elements for applying a bias charge to said protective elements, and said second potential source has a lower potential than said first potential source.

7. The apparatus of claim 6 wherein said first and second potential sources have a common supply, and said apparatus further includes means connected to said common supply for reducing the potential of said common supply to said lower potential.

8. The apparatus of claim 1 wherein said potential and the conveyed base are grounded.

* * * * *